US008222549B2

(12) United States Patent
Burca et al.

(10) Patent No.: US 8,222,549 B2
(45) Date of Patent: Jul. 17, 2012

(54) INPUT CONTROL MODULE WITH ADAPTIVE ACTUATORS

(75) Inventors: John Burca, Rochester Hills, MI (US); Frank Buccinna, Livonia, MI (US); Bruce Pierik, Hazel Park, MI (US); John Stack, Shelby Township, MI (US)

(73) Assignee: Lear Corporation, Southfield, MI (US)

( * ) Notice: Subject to any disclaimer, the term of this patent is extended or adjusted under 35 U.S.C. 154(b) by 1584 days.

(21) Appl. No.: 11/276,667

(22) Filed: Mar. 9, 2006

(65) Prior Publication Data

US 2007/0209914 A1 Sep. 13, 2007

(51) Int. Cl.
*H01H 1/64* (2006.01)
*H01H 1/66* (2006.01)
*H01H 13/04* (2006.01)

(52) U.S. Cl. ..... 200/293

(58) Field of Classification Search ..... 200/293, 200/296

See application file for complete search history.

(56) References Cited

U.S. PATENT DOCUMENTS 4,972,057 A * 11/1990 Miyata ..... 200/293
5,087,802 A 2/1992 Guilleminot
5,117,075 A * 5/1992 Guilleminot ..... 200/343
6,126,221 A * 10/2000 Kern ..... 296/37.7
6,613,990 B2 * 9/2003 Kawasaki ..... 200/6 A
6,963,039 B1 * 11/2005 Weng et al. ..... 200/302.1
7,138,593 B2 * 11/2006 Toyoda ..... 200/345

FOREIGN PATENT DOCUMENTS

DE 29820853 U1 5/2000
DE 10241275 A1 3/2004
JP 05198232 A 1/1992

OTHER PUBLICATIONS

UK Intellectual Property Office, Combined Search and Examination Report under Sections 17 and 18(3), Jun. 29, 2007, 6 pages, South Wales.

* cited by examiner

*Primary Examiner* — Renee Luebke
*Assistant Examiner* — Lheiren Mae Caroc
(74) *Attorney, Agent, or Firm* — Brooks Kushman P.C.

(57) ABSTRACT

An electronic input control assembly adjusts to the shape of a receiving assembly. The input control assembly includes an input control module and an actuator module. The actuator module has one or more actuators that are manually activated by a user. Advantageously, the input control module and the actuator module are moveably attached in a manner allowing relative motion which facilitates alignment when the input control assembly is placed within a receiving assembly. A garage door opener utilizes this adjustable design. A method of assembly the input control assembly is described.

16 Claims, 4 Drawing Sheets

INPUT CONTROL MODULE WITH ADAPTIVE ACTUATORS

BACKGROUND OF THE INVENTION

1. Field of the Invention

The present invention relates to electronic control assemblies with adjustable positioning of sub-components of the control assemblies, and in particular, to garage door open systems using such electronic control assemblies.

2. Background Art

The associated costs of electronically controlled systems, and in particular, electronically controlled systems in automobiles provides an ever increasing impetus to find cost reducing strategies. Increasing complexity of such electronically controlled systems along with a desire to integrate such components into a vehicle in an aesthetically pleasing manner adds to the costs of such systems. Garage door openers are one example of such electronically controlled systems.

In addition to the costs of the components of such electronic systems, there is also an increase cost associated with the fabrication and assembly of these electronically controlled systems. Since these systems typically include several sub-assemblies that must be put together, physical tolerances of the components become an issue with misalignment being multiplied as the components are assembled. In the case of systems that use switch modules that are manually operated by a user, these misalignments are often associated with sticking or jammed buttons and switches. Garage door openers are an example of such a system using a switch module.

Accordingly, there exists a need for improved electronic control systems that are easily assembled and have flexibility with respect to the physical tolerances of any sub-assemblies and components.

SUMMARY OF THE INVENTION

The present invention solves one or more problems of the prior art by providing in at least one embodiment, an electronic input control assembly that adjusts to the shape of a receiving assembly. The input control assembly of the invention comprises an input control module and an actuator module. The actuator module includes one or more actuators that are manually activated by a user. Advantageously, the input control module and the actuator module are moveably attached in a manner allowing relative motion. The relative positionability of the input control module to the actuator module facilitates alignment with a receiving assembly that includes mounting or bezel openings.

In another embodiment of the invention, a method for assembling an electronic control device such as a garage door opener is provided. The method of this embodiment comprises attaching an input control module to an actuator module. The input control module includes first connectors while the actuator module includes second connectors that are connected to the first connectors such that the input control module is moveable relative to the actuator module. The thus formed control assembly is positioned within a receiving assembly. The relative positions of the input control module and the actuator modules are adjusted such that the control assembly is aligned with the shape receiving assembly without any buttons of the actuator module sticking to the receiving assembly.

DETAILED DESCRIPTION OF THE PREFERRED EMBODIMENT(S)

Reference will now be made in detail to presently preferred compositions or embodiments and methods of the invention, which constitute the best modes of practicing the invention presently known to the inventors.

As used herein, the term "input control module" means an electronic device containing an input device that allows a person to enter data into or control another device. Typically, such input devices are switches that are actuated by a user. Input control modules are used in any electronically controlled or operated device or system (e.g., a garage door openers, keyless entry systems, keyboards, and the like).

As used herein, the term "actuator module" means a module that includes the physical devices manually operated by a user operating the input control module. Typically, such actuator modules include buttons or switches that are activated by the users. The actuator module includes one or more physical structures (i.e., actuators) that transfer the user input to the input control module.

Figure 1A:
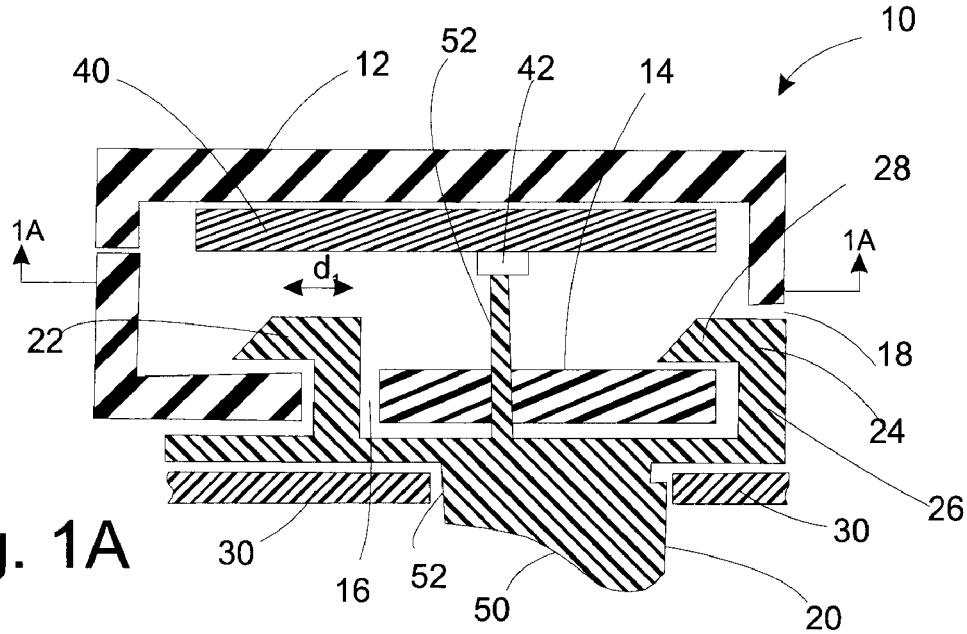
FIG. 1A is an idealized cross-section of an input control assembly of an embodiment of the present invention that includes an input control module and an actuator module.
Figure 1B:
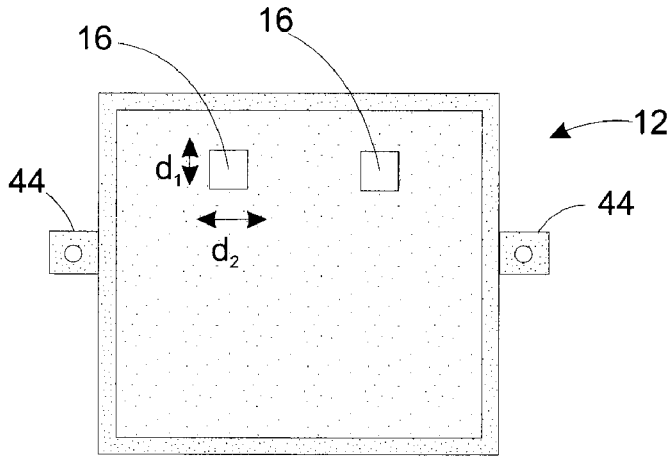
FIG. 1B is a cross-section of the actuator module illustrated in FIG. 1A.
Figure 1C:
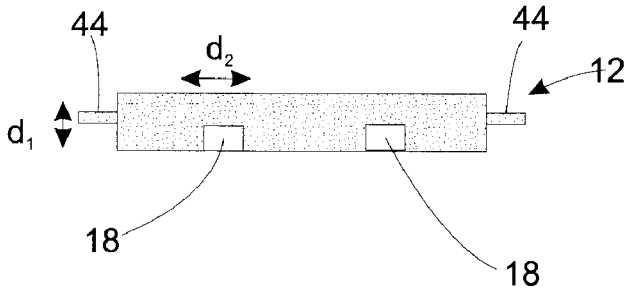
FIG. 1C is a side view of the actuator module illustrated in FIG. 1A.

In one embodiment of the present invention, an electronic input control assembly attachable to a receiving assembly is provided. With reference to FIGS. 1A, 1B, and 1C, schematics of the electronic input control assembly of the present invention is provided. FIG. 1A is an idealized cross-section of the input control assembly which includes an input control module and an actuator module. FIG. 1B shows an idealized section of the actuator module. FIG. 1C is a side view of the actuator module. Input control assembly 10 includes input control module 12 having side 14 that defines one or more first connectors 16, 18. In one variation of the present embodiment, first connectors 16, 18 are slots of various configurations. Input control assembly 10 also includes actuator module 20. Actuator module 20 includes one or more second connectors 22, 24 which are used to attach actuator module 20 to input control module 12. Typically, second connectors 22, 24 are barbed extensions having extension section 26 and barb section 28.

Still referring to FIGS. 1A, 1B, and 1C, attachment of input control module 12 to actuator module 20 is accomplished by positioning second connectors 22, 24 within first connectors 16, 18 such that input control module 12 is moveable relative to the actuator module 20 allowing adjustment of the relative positions of input control module 12 and actuator module 20. This relative moveablity allows control assembly 10 to adjust to the shape of the receiving assembly 30. In a variation of this embodiment, second connectors 22, 24 are moveable within first connectors 16, 18 along two orthogonal directions $d_1$ and $d_2$. Although the extent of the motion along directions $d_1$ and $d_2$ are of any amount compatible with the sizes of the components, typically second connectors 22, 24 are moveable within first connectors 16, 18 over a distance of about 0.25 inches or less along each of the two orthogonal directions. Adjustability over this distance scale provides sufficient adjustability to allow input control assembly to align to the shape of receiving assembly 30. It should be appreciated that in the most general implementation of the invention, the term first and second connectors merely means a mated pair of structures that fit together for the purposes of connecting input control module 12 to actuator module 20. Accordingly, any specific implementation of the first and second connectors may be switched.

Input control module 12 also includes electronic device 40 which includes one or more electronic components 42 that are activated by actuator module 20. In a variation of the present embodiment, electronic device 40 comprises an electronic circuit board and electronic components 42 are switches (e.g., tact switches). Input control module 12 also includes attachment section 44 which are utilized to attach input control assembly 10 to receiving assembly 30. Examples of such receiving assemblies include vehicle bezel or trim components.

In a variation of the present embodiment, actuator module 20 includes at least one button(s) 50 with attached actuator shaft(s) 52. In this variation, actuator 20 is a switch module. When button 50 is manually activated by a user, actuator shaft 52 engages electronic component 42 thereby initiating the pre-designed action of input control module 12 associated with electronic component 42's activation (or deactivation). In one particularly important variation, input module 12 is part of a garage door opener system, and in particular, a transmitter for a garage door opener system which is integrated into the passenger compartment of an automobile. In a variation of the present embodiment, receiving assembly 30 includes a mounting plate having openings 52 into which button 50 protrudes. It is readily appreciated that it is the relative moveability of input control module 12 and actuator module 20 that allows for button(s) 50 to properly fit into openings 52 without sticking.

Figure 2:
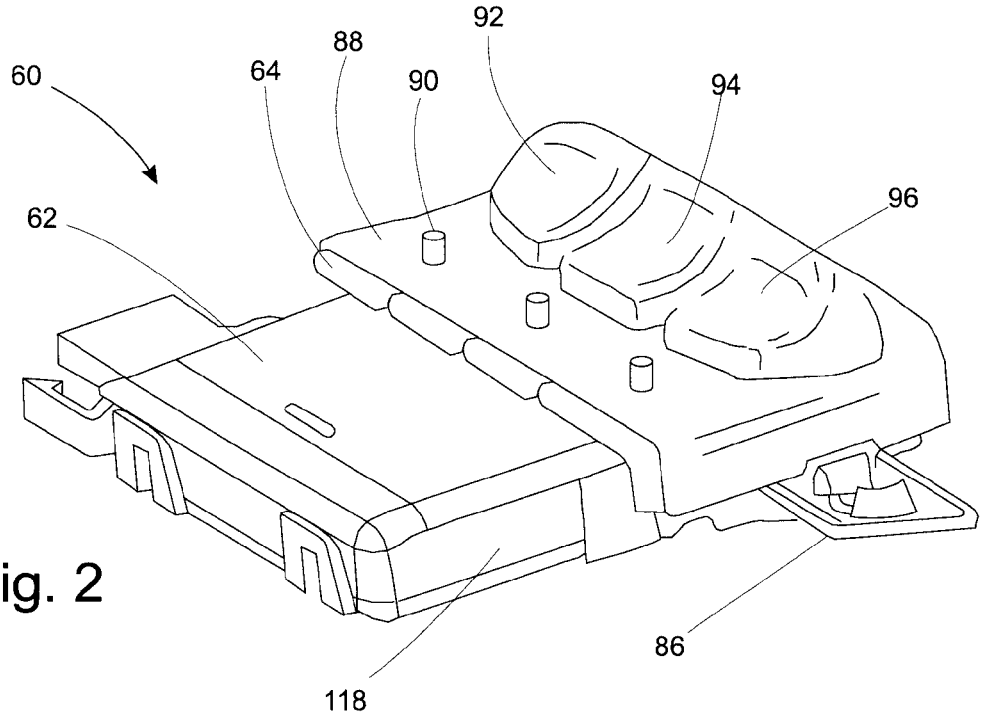
FIG. 2 is a perspective view of a garage door opener of an embodiment of the present invention.
Figure 3:
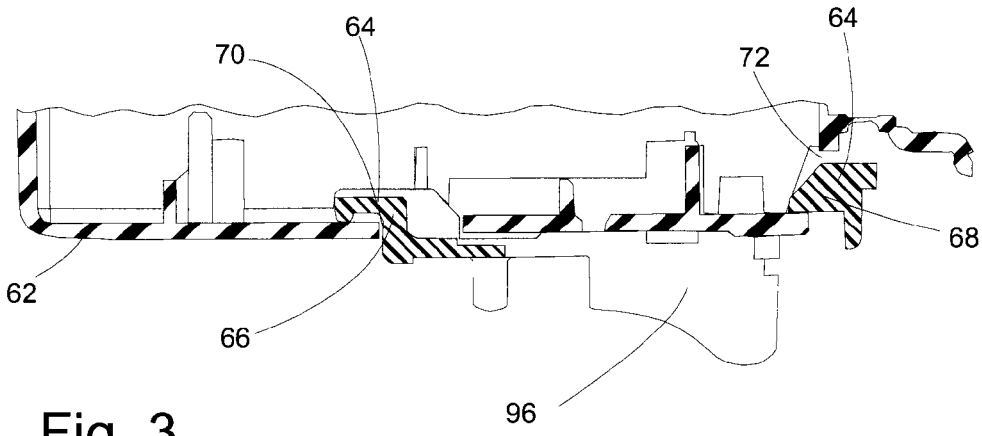
FIG. 3 is a cross-sectional view showing attachment of the input control module to the actuator module in the garage door opener of FIG. 2.

In another embodiment of the present invention, a garage door opener utilizing the design of the input control assembly 10 set forth above is provided. The garage door opener of this embodiment is advantageously incorporated into the overhead console of a vehicle interior. With reference to FIGS. 2 and 3, views of the garage door opener of the invention are provided. FIG. 2 is a perspective view of the garage door opener of this embodiment. Garage door opener transmitter 60 includes input control module 62 and actuator module 64. Actuator module 64 includes connectors 66, 68 which fit into slots 70, 72 of input control module 62. As set forth above, slots 70, 72 are somewhat oversized thereby allowing connectors 66, 68 to be moveable when they are positioned within slots 70, 72. Garage door opener transmitter 60 attaches to a receiving assembly via attachment sections 86. Actuator module 84 is optionally covered with soft touch layer 88 which is held in position via pegs 90. Actuator module 64 includes buttons 92, 94, 96. Typically, actuator module 84 is a switch module.

Figure 4:
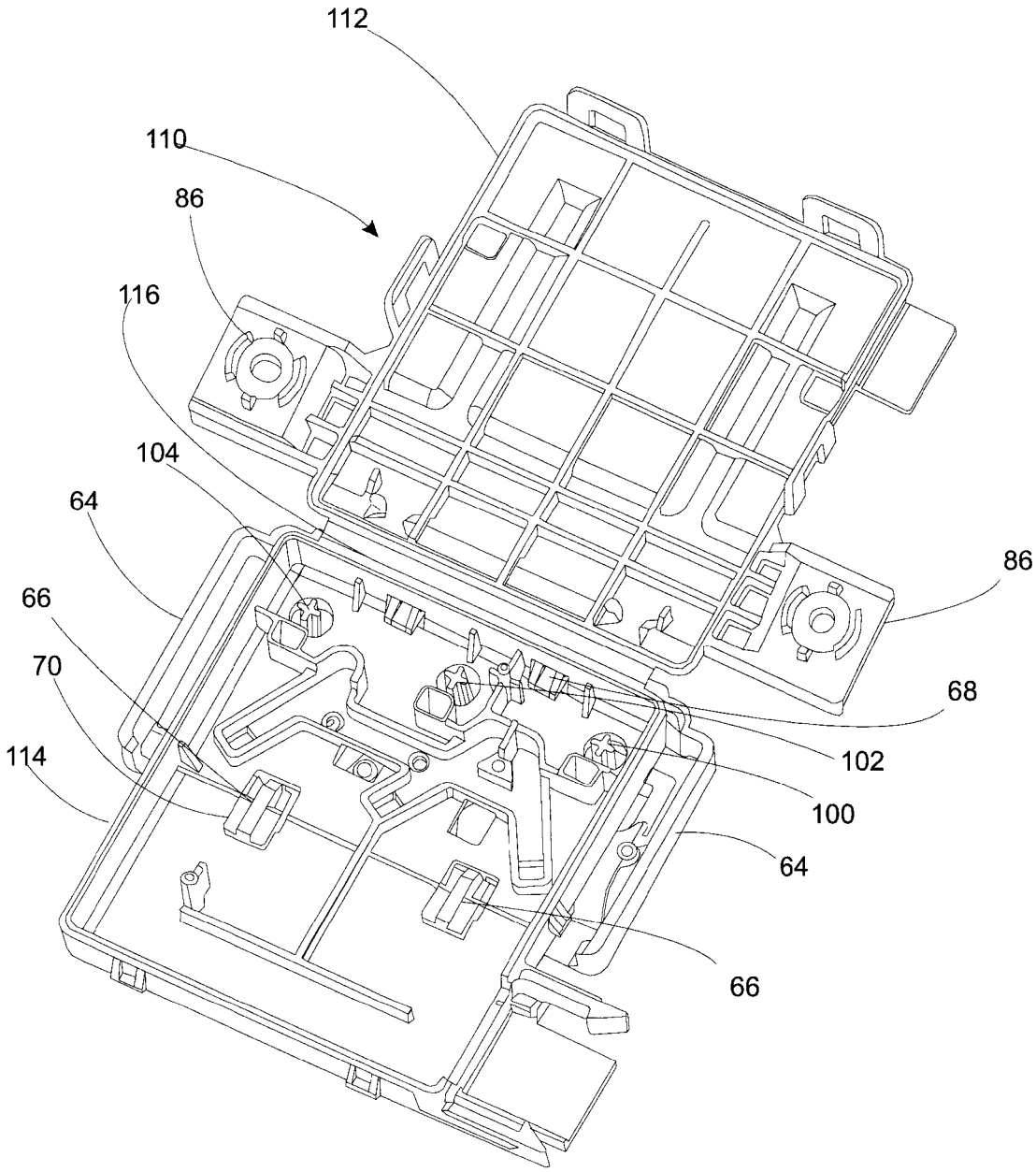
FIG. 4 is a perspective view of the actuator module in the garage door opener of FIG. 2.
Figure 5:
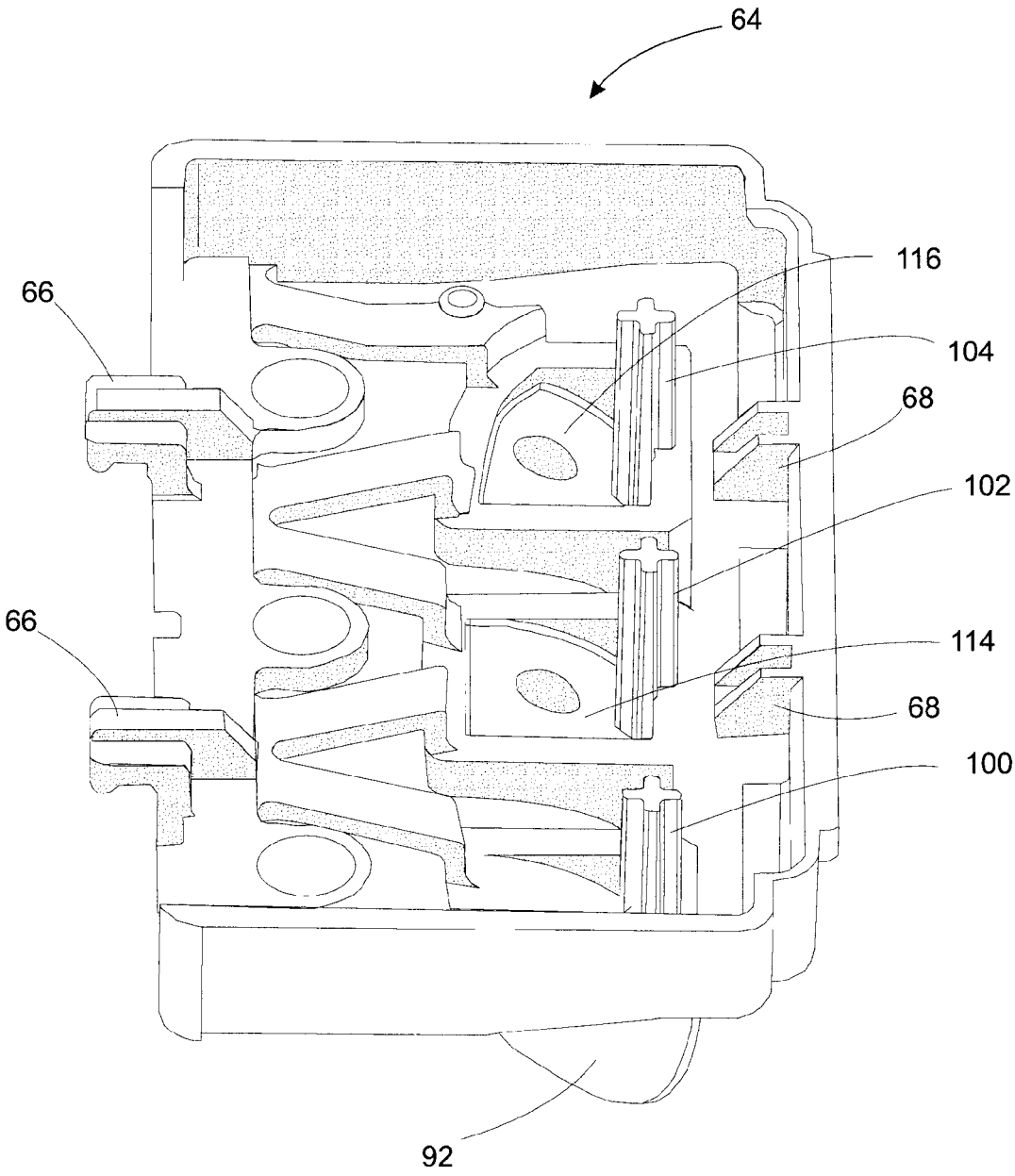
FIG. 5 is a perspective view showing attachment of the input control module to the actuator module in the garage door opener of FIG. 2.

With reference to FIGS. 2, 3, 4 and 5, schematics illustrating components of garage door opener transmitter 60 are provided. FIG. 4 is a perspective view of the bottom side of actuator module 64. FIG. 5 is a perspective view of an encasement of input control module 62 with actuator module 64 attached thereto. Actuator module 64, as illustrated, is a switch module that includes buttons 92, 94, 96. Actuator shafts 100, 102, 104 are attached to a bottom side of buttons 92, 94, 96. It is actuator shafts 100, 102, 104 that contact switches in input control module 62 upon operation of buttons 92, 94, 96 by a user. In a variation of the present embodiment, operation of buttons 92, 94, 96 will initiate the opening and closing of a garage door. Input control module 62 includes encasement 110 which includes encasement section 112 and encasement section 114. Encasement section 112 and encasement section 114 are closed along hinge section 116 to form closed encasement 118. An electronic device such as a printed circuit board is positioned with encasement 118. The electronic device includes one or more switches that are activated by buttons 92, 94, 96 and actuator shafts 100, 102, 104 as set forth above.

In another embodiment of the present invention, a method for assembling an electronic control device is provided. With reference to FIGS. 1A, 1B, and 1C, input control assembly 10 is assembled by attaching input control module 12 to actuator module 20. Actuator module 20 is attached to the input control module 12 by positioning second connectors 22, 24 within first connectors 16, 18 such input control module 12 is moveable relative to actuator module 20 due to moveability of second connectors 22, 24 relative to first connectors 16, 18. Input control assembly 10 is then positioned within receiving assembly 30. Receiving assembly 30 is adapted to receive input control assembly 10 and includes a mating region having a shape that conforms to at least a portion of the input control assembly 10 within predetermined tolerances. Utilizing the relative moveablity between input control module 12 and actuator module 20, the relative position of input control module 12 and actuator module 20 is adjusted such that the control assembly is aligned with the shape of the mating region.

The details of input control assembly 10 are set forth above. In particular, the position adjustment of the present embodiment is accomplished by the relative movement of second connectors 22, 24 with first connectors 16, 18 along the two orthogonal directions $d_1$ and $d_2$. In a variation, second connectors 22, 24 are moveable within first connectors 16, 18 over a distance of about 0.25 inches or less along each of the two orthogonal directions.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An electronic input control assembly attachable to a receiving assembly, the control assembly comprising:

an input control module having a first slot connector and second slot connector, the first slot connector and the second slot connector each independently having a slot, the input control module including a first encasement section, a second encasement section, a hinge section, and an electronic device, the first and second encasement section being closed along the hinge section to form a closed encasement, the electronic device being positioned within the closed encasement; and an actuator module having a first barbed connector and a second barbed connector, the first barbed connector and the second barbed connector each independently having a barbed extension, the actuator module being attached to the input control module with the first barbed connector and the second barbed connector respectively positioned in the first slot connector and the second slot connector such that the input control module is moveable relative to the actuator module due to movability of the first barbed connector and the second barbed connector relative to the first slot connector and the second slot connector thereby allowing adjustment of relative positions of the input control module and actuator module so that the control assembly adjusts to a shape of the receiving assembly.

2. The electronic input control assembly of claim 1 wherein the first barbed connector and the second barbed connector are moveable within the first slot connector and the second slot connector respectively along two orthogonal directions.

3. The electronic input control assembly of claim 2 wherein the first barbed connector and the second barbed connector are moveable within the first slot connector and the second slot connector respectively over a distance of about 0.25 inches or less along each of the two orthogonal directions.

4. The electronic input control assembly of claim 1 wherein the actuator module comprises at least one button and an actuator shaft attached to the at least one button.

5. The electronic input control assembly of claim 4 wherein the electronic device has a switch in communication with the actuator shaft such that activation of the at least one button causes operation of the switch.

6. The electronic input control assembly of claim 1 wherein the electronic device is part of a garage door opener.

7. The electronic input control assembly of claim 1 further comprising one or more attachment sections adapted to attach the control assembly to the receiving assembly.

8. A garage door opener transmitter comprising:

an input control module having a first slot connector and second slot connector, the first slot connector and the second slot connector each independently having a slot, the input control module initiating opening or closing of a garage door, the input control module including a first encasement section, a second encasement section, a hinge section, and an electronic device, the first and second encasement section being closed along the hinge section to form a closed encasement, the electronic device being positioned within the closed encasement; and an actuator module having a first barbed connector and a second barbed connector, the first barbed connector and the second barbed connector each independently having a barbed extension, the actuator module being attached to the input control module with the first barbed connector and the second barbed connector respectively positioned in the first slot connector and the second slot connector such that the input control module is moveable relative to the actuator module due to movability of the first barbed connector and the second barbed connector relative to the first slot connector and the second slot connector allowing adjustment of relative positions of the input control module and actuator module so that the input control module adjusts to a shape of a receiving assembly.

9. The garage door opener transmitter of claim 8 wherein the first barbed connector and the second barbed connector are moveable within the first slot connector and the second slot connector respectively along two orthogonal directions.

10. The garage door opener transmitter of claim 8 wherein the actuator module comprises at least one button and an actuator shaft attached to the at least one button.

11. The garage door opener transmitter of claim 8 further comprising one or more attachment sections adapted to attach the input control module to the receiving assembly.

12. The garage door opener transmitter of claim 8 wherein the receiving assembly comprises a vehicle bezel or trim component.

13. A method for assembling an electronic control device, the method comprising:

a) attaching an input control module having a first slot connector and second slot connector, the first slot connector and the second slot connector each independently having a slot, to an actuator module having a first barbed connector and a second barbed connector, the first barbed connector and the second barbed connector each independently having a barbed extension to form a control assembly, the actuator module being attached to the input control module with the first barbed connector and the second barbed connector respectively positioned in the first slot connector and the second slot connector such that the input control module is moveable relative to the actuator module due to movability of the first barbed connector and the second barbed connector relative to the first slot connector and the second slot connector, the input control module including a first encasement section, a second encasement section, hinge section, and an electronic device, the first and second encasement section being closed along the hinge section to form a closed encasement, the electronic device being positioned within the closed encasement;

b) positioning the control assembly within a receiving assembly, the receiving assembly having a mating region having a shape that conforms to at least a portion of the control assembly within predetermined tolerances, the receiving assembly being adapted to receive the control assembly; and c) adjusting relative positions of the input control module and the actuator modules such that the input control module aligns with the shape of the mating region.

14. The method of claim 13 wherein the first barbed connector and the second barbed connector are moveable within the first slot connector and the second slot connector respectively along two orthogonal directions.

15. The method of claim 14 wherein the first barbed connector and the second barbed connector are moveable within the first slot connector and the second slot connector respectively over a distance of about 0.25 inches or less along each of the two orthogonal directions.

16. The method of claim 13 wherein the actuator module comprises at least one button and an actuator shaft attached to the at least one button.

* * * * *